United States Patent [19]

Byerley

[11] 3,991,720

[45] Nov. 16, 1976

[54] J TUBE DISCHARGE OR FEEDWATER HEADER

[75] Inventor: Wilbur M. Byerley, Riverview, Fla.

[73] Assignee: Westinghouse Electric Corporation, Pittsburgh, Pa.

[22] Filed: Jan. 29, 1975

[21] Appl. No.: 545,235

[52] U.S. Cl. ..... 122/32; 122/438

[51] Int. Cl.[2] ..... F22B 1/06; F22D 1/28

[58] Field of Search ..... 122/32, 33, 34, 412, 122/438

[56] References Cited

UNITED STATES PATENTS

| | | | |
|---|---|---|---|
| 2,903,187 | 9/1959 | Coykendall | 122/438 X |
| 3,661,123 | 5/1972 | Romanos | 122/34 |
| 3,854,453 | 12/1974 | Mayer et al. | 122/34 |

*Primary Examiner*—Kenneth W. Sprague
*Attorney, Agent, or Firm*—F. J. Baehr, Jr.

[57] ABSTRACT

A shell and tube steam generator having a feedwater inlet ring disposed above the tubes, the feedwater inlet ring having a plurality of J-shaped discharge nozzles asymmetrically disposed in fluid communication with the upper portion thereof.

10 Claims, 4 Drawing Figures

J TUBE DISCHARGE OR FEEDWATER HEADER

BACKGROUND OF THE INVENTION

This invention relates to steam generators for nuclear power plants and more particularly to such steam generators having a feedwater inlet ring disposed in the upper portion thereof.

During operation of the steam generator with a feedwater ring disposed in the upper portion thereof, a severe water hammer may develop in the feedwater lines during transient operating condition as the feedwater ring becomes uncovered and the feedwater drains through holes located in the bottom thereof, allowing steam to enter the ring and the adjacent piping so that when the feedwater flow is returned to normal, a water hammer occurs in the feedwater pipe and in ring header.

SUMMARY OF THE INVENTION

In general, a vapor generator utilizing a primary fluid to vaporize a secondary fluid, when made in accordance with this invention, comprises a shell portion, a plurality of tubes forming a tube bundle and disposed within the shell, a tube sheet having a plurality of openings disposed therein for receiving ends of the tube, a wrapper encircling the tube bundle and forming an annular space adjacent to the shell, an inlet header for the secondary fluid in fluid communication with the inlet nozzle. The inlet header has a plurality of discharge nozzles disposed in fluid communication with the upper portion of the inlet header. The discharge nozzle including reverse bends, whereby the header remains filled with secondary fluid even though the level within the shell drops below the header.

BRIEF DESCRIPTION OF THE DRAWINGS

The object and advantages of this invention will become more apparent from reading the following detailed descriptions in connection with the accompanying drawings, in which.

DESCRIPTION OF THE PREFERRED EMBODIMENT

Figure 1:
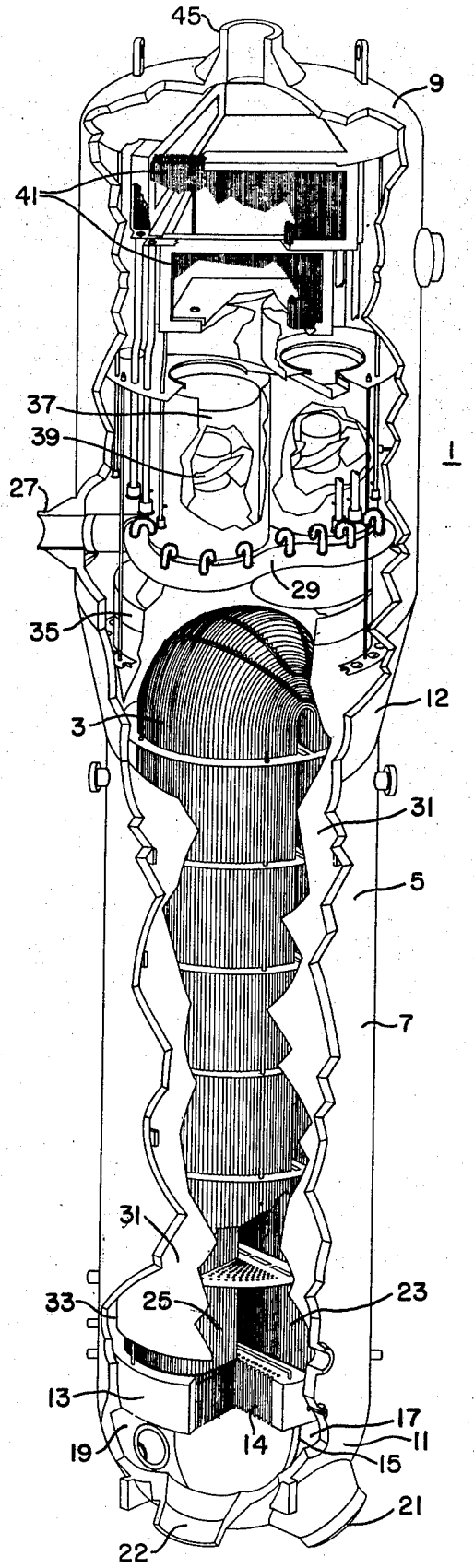
FIG. 1 is a perspective view of a steam generator, made in accordance with this invention.

Referring now to the drawings in detail, FIG. 1 shows a steam or vapor generator 1 which utilizes a U-shaped bundle of tubes 3 to provide the heating surface required to transfer heat from a primary fluid to vaporize or boil a secondary fluid. The steam generator 1 comprises a vessel 5 having a vertically oriented tubular shell portion 7 and an enclosure or flange and dished head 9 enclosing one end of the shell 7, the upper end, and a spherical shaped channel head 11 enclosing the other end of the shell, the lower end. The lower portion of the shell 7 is smaller in diameter than the upper portion and a frustoconical shaped transition member 12 connects the upper and lower portion. A tube sheet 13 is made integral with the channel head and has a plurality of holes 14 disposed therein to receive ends of the U-shaped tubes 3. A dividing plate 15 is centrally disposed in the channel head 11 to divide the channel head in two compartments 17 and 19, which serves as headers for the tubes 3. The compartment on the right as shown in FIG. 1 is the primary fluid inlet compartment 17, and has a primary fluid inlet nozzle 21 in fluid communication therewith. The compartment on the left, as shown in FIG. 1, is the primary fluid outlet compartment 19 and has a primary fluid outlet nozzle 22 disposed in fluid communication therewith, thus causing the primary inlet fluid to flow through the tubes thereby creating a hot leg portion 23, the portion shown on the right in the drawings, and a cold leg portion 25, the portion shown on the left of the drawings. A secondary fluid or feedwater inlet nozzle 27 is disposed in the upper portion of the shell 7 above the tube bundle and has a ring header 29 in fluid communication therewith.

The tube bundle 3 is encircled by a wrapper 31 which encloses the tube bundle and forms an annular chamber 33 between the wrapper 31 and the shell 7.

The wrapper 31 has an upper cover or head 35 disposed above the bends of the tubes 3. The head 35 has a plurality of openings in communication with a tube 37 which has swirl vanes 39 disposed therein to cause steam flowing therethrough to spin and centrifugally remove some of the moisture contained therein as it flows through the centrifugal separator. After flowing through the centrifugal separator the steam then passes through a chevron-type separator 41 before reaching a secondary fluid out nozzle 45 centrally disposed and the flange and dished head 9.

Figure 2:
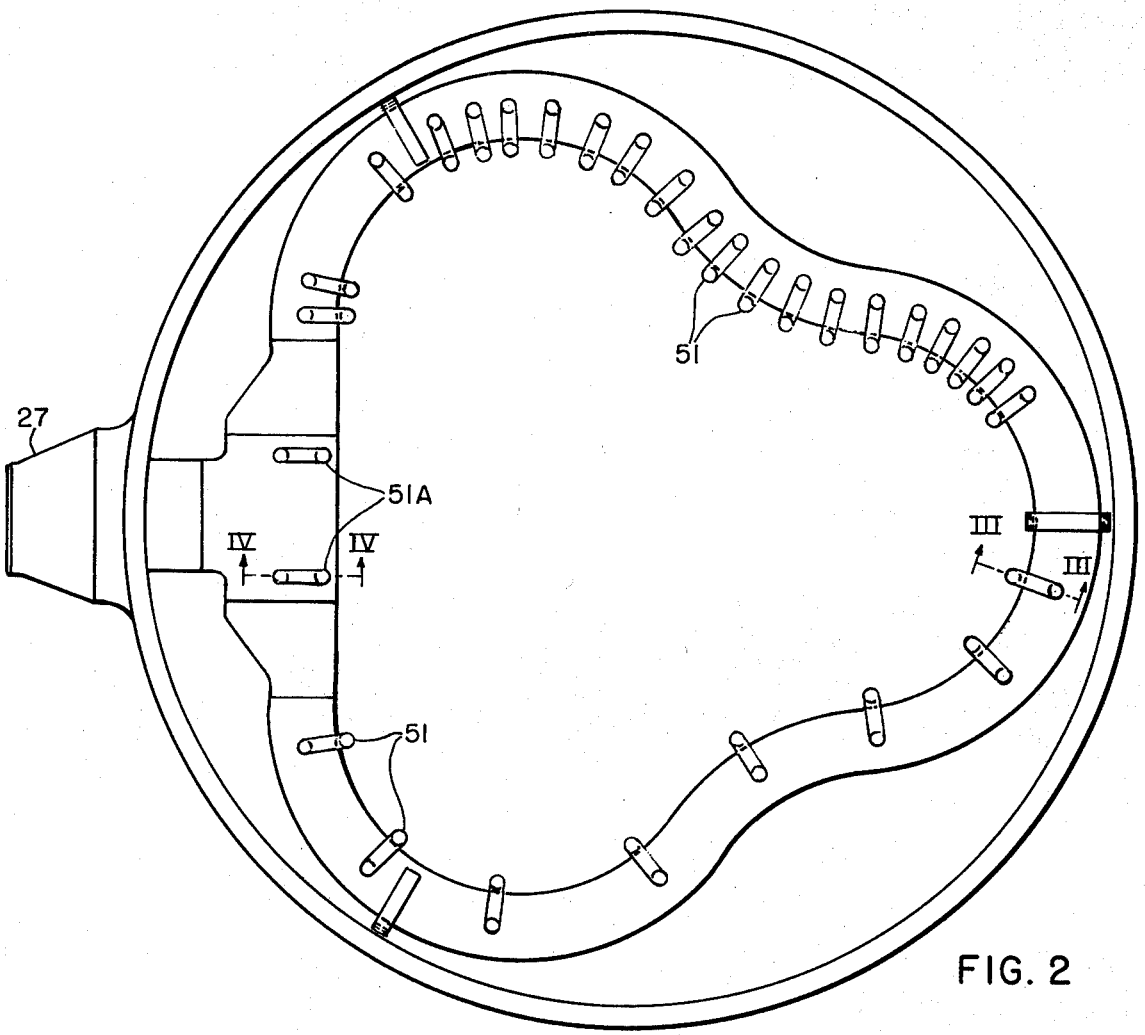
FIG. 2 is a plan view of a feedwater ring header made in accordance with this invention.

The ring header 29 encircles the centrifugal separators and as shown in FIG. 2 comprises three loops forming a generally clover-shaped ring.

The inlet nozzle 27 joins the ring header 29 and forms a T therewith. The ring header 29 has a plurality of J shaped discharge nozzles 51 which are asymmetrically disposed on the upper portion thereof with the greater number of the discharge nozzles being disposed on the hot leg portion of the ring header to enhance the thermal conditions within the steam generator by providing a discharge of about 80% of the feedwater flow down the hot leg side of the steam generator. While the asymmetrical arrangement is preferred, symmetrical disposition of the J shape nozzles 51 is considered to be within the scope of this invention.

Figure 4:
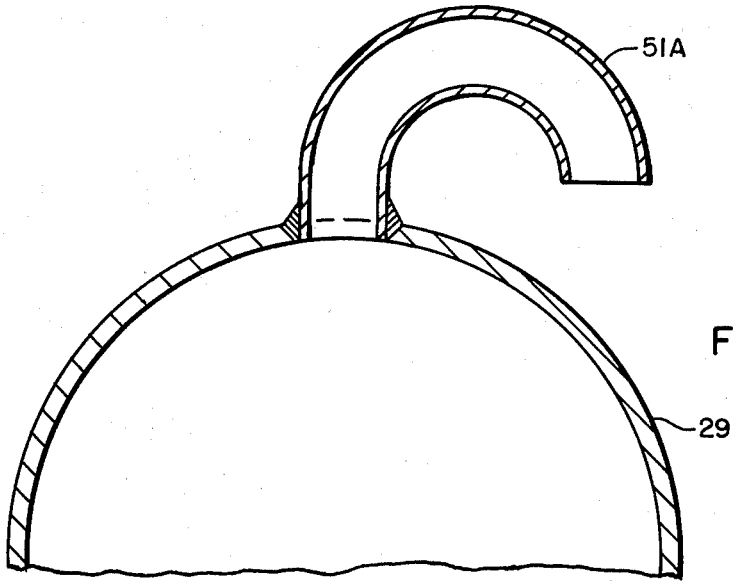
FIG. 4 is a sectional view taken on Line IV—IV of FIG. 2.
Figure 3:
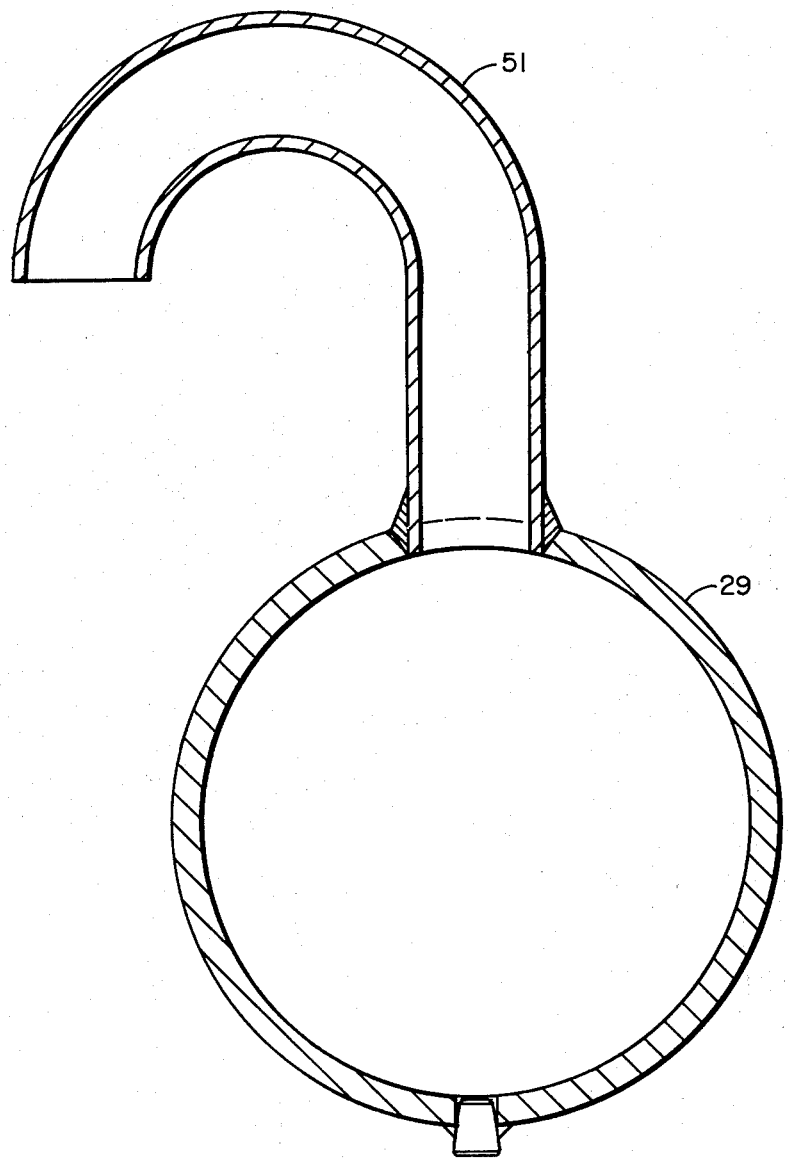
FIG. 3 is a sectional view taken on Line III—III of FIG. 2.

As shown in FIGS. 3 and 4 the discharge nozzles 51 are so disposed that the leg of the J is in fluid communication with the ring header and they have a reversed bend so disposed that the discharge nozzles discharge into the area enclosed by the ring header 29. The discharge nozzles 51A adjacent to the inlet nozzle 27 have a shorter stem than the other discharge nozzle 51 so that the discharge nozzles 51A are at a slightly lower elevation than the other J shaped nozzles which assists in venting steam from the ring header 29 should it become entrapped therein.

The feedwater inlet header 29 and discharge nozzle 51 in fluid communication therewith advantageously cooperate to prevent a water hammer should the water level within the steam generator drop below the feedwater nozzle during some transient operating conditions.

What is claimed is:

1. A vapor generator utilizing a primary fluid to vaporize a secondary fluid, said vapor generator comprising a shell portion, a plurality of tubes forming a tube bundle and disposed within said shell portion, a tube sheet having a plurality of openings disposed therein for receiving end of said tubes, a wrapper encircling said tube bundles and forming an annular space adjacent to said shell, an inlet header for said secondary fluid, an inlet nozzle for said secondary fluid in fluid communication with said inlet header, a plurality of discharge nozzles in fluid communication with the upper portion of said inlet header, at least one of said discharge nozzles being disposed adjacent said inlet nozzle and being at a lower level than the majority of said other discharge nozzles, said discharge nozzles including a reverse bend, whereby said header remains filled with said secondary fluid even if the level within the shell drops below said header.

2. A vapor generator as set forth in claim 1, wherein the outlet end of the discharge nozzles are disposed above the upper portion of said ring header.

3. A vapor generator as set forth in claim 1, wherein the outlet end of said discharge nozzles is so disposed that they discharge into an area encircled by said ring header.

4. A vapor generator as set forth in claim 1, wherein the inlet header forms a continuous ring.

5. A vapor generator as set forth in claim 3, wherein the discharge nozzles are so oriented that they discharge inwardly with respect to the ring header. .

6. A vapor generator utilizing a primary fluid to vaporize a secondary fluid, said vapor generator comprising a shell portion, a plurality of tubes forming a tube bundle and disposed within said shell portion, a tube sheet having a plurality of openings disposed therein for receiving end of said tubes, a wrapper encircling said tube bundles and forming an annular space adjacent to said shell, an inlet header for said secondary fluid, an inlet nozzle for said secondary fluid in fluid communication with said inlet header, a plurality of discharge nozzles in fluid communication with the upper portion of said inlet header, said discharge nozzles being asymmetrically disposed on said discharge header so as to enhance the distribution of influent secondary fluid to said vapor generator, said discharge nozzles including a reverse bend, whereby said header remains filled with said secondary fluid even if the level within the shell drops below said header.

7. A vapor generator as set forth in claim 6, wherein the outlet end of the discharge nozzles are disposed above the upper portion of said ring header.

8. A vapor generator as set forth in claim 6, wherein the outlet end of said discharge nozzles is so disposed that they discharge into an area encircled by said ring header.

9. A vapor generator as set forth in claim 6, wherein the inlet header forms a continuous ring.

10. A vapor generator as set forth in claim 8, wherein the discharge nozzles are so oriented that they discharge inwardly with respect to the ring header.

* * * * *